United States Patent [19]

Livemore

[11] 3,998,608

[45] Dec. 21, 1976

[54] PRODUCTION OF HOT CLEAN INDUSTRIALLY USABLE GAS

[75] Inventor: Gerald Sydney Victor Livemore, Sandton, South Africa

[73] Assignee: Foster Wheeler Energy Corporation, Livingston, N.J.

[22] Filed: Aug. 12, 1975

[21] Appl. No.: 603,987

[30] Foreign Application Priority Data

Aug. 15, 1974 South Africa ..... 74/5251

[52] U.S. Cl. ..... 48/197 R; 48/76; 48/128; 55/126

[51] Int. Cl.[2] ..... C10K 1/02

[58] Field of Search ..... 48/128, 76, 197 R; 55/126, 150

[56] References Cited

UNITED STATES PATENTS

| | | | |
|---|---|---|---|
| 2,356,717 | 8/1944 | Williams | 55/126 |
| 2,873,000 | 2/1959 | Elam | 55/126 |
| 3,032,410 | 5/1962 | O'Day | 55/126 |
| 3,293,829 | 12/1966 | Mafrica | 55/150 |
| 3,454,382 | 7/1969 | Hamilton | 48/76 |
| 3,460,934 | 8/1969 | Kelmar | 55/126 |
| 3,807,140 | 4/1974 | Gurvits et al. | 55/154 |

FOREIGN PATENTS OR APPLICATIONS

| | | | |
|---|---|---|---|
| 792,068 | 3/1958 | United Kingdom | 55/150 |

*Primary Examiner*—Robert L. Lindsay, Jr.
*Assistant Examiner*—George C. Yeung
*Attorney, Agent, or Firm*—Marvin A. Naigur; John E. Wilson

[57] ABSTRACT

A method and apparatus of producing industrially usable gas is disclosed wherein hot detarred gas produced in conventional manner is passed through a plate type precipitator adapted to remove from the gas at least some of the remaining contaminants, mainly the solid and fluids of relatively low volatility.

3 Claims, 1 Drawing Figure

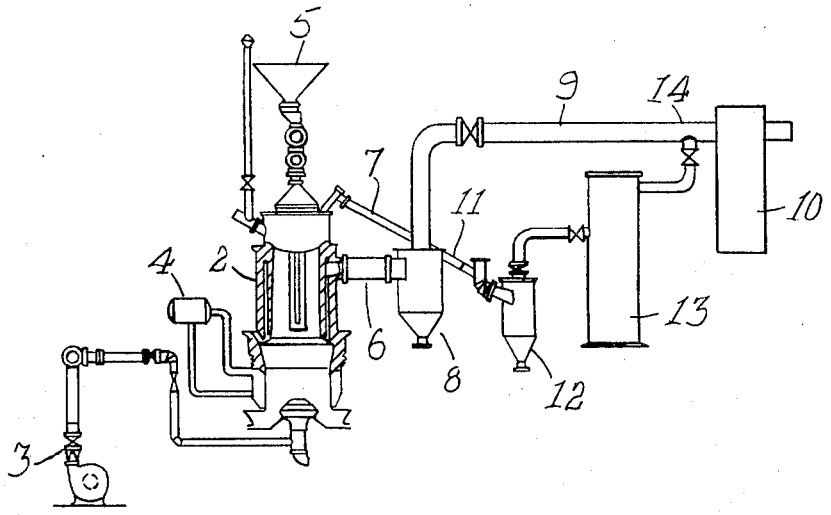
5
9
14
7
11
10
4
2
13
6
8
12
3

PRODUCTION OF HOT CLEAN INDUSTRIALLY USABLE GAS

This invention relates to the production of industrially usable gas. By industrially usable gas the applicant is concerned with the type of gas which is known technically as 'producer gas' and one known gas mixture of this nature for example has substantially the following composition on a volume/volume basis:

| | |
|---|---|
| Carbon Dioxide | 1% |
| Carbon Monoxide | 31% |
| Hydrogen | 5% |
| Methane | 2% |
| Nitrogen | 61% |

Conventionally gas of this nature may be produced mainly in three manners, namely by means of hot raw gas plants, hot detarred gas plants and cold clean gas plants. There are certain disadvantages attached to the gases produced in each of the aforesaid manners. Thus, for example, the gas produced in hot raw gas plants carried a certain amount of tars which, apart from the fact that they render the gas unclean for certain industrial applications, as for example, the manufacturing of detergents, they also tend to precipitate from the gas on cooling thus making transportation over long distances by means of pipe lines for example extremely difficult.

In the so called 'clean' plants the tars are removed from the gas but in the existing arrangements this is not achieved without difficulties.

Thus, for example, because of the relative low temperature of the gas produced in cold clean plants certain phenols entrained in the gas tend to come out with the tars when the latter are being removed. Since such phenols by law may not be treated as ordinary waste material their disposal presents a problem and usually requires their burning off into the atmosphere from a stack of substantial height.

In the case of the conventional hot detarred gas plants again removal of the tars take place at such elevated temperatures that other more volatile and other contaminants in the gas remain entrained in the final product so that the latter is still rendered 'unclean' in a technical sense.

It is accordingly an object of this invention to provide a method and means for the production of hot clean detarred gas which the applicant believes will have distinct advantages over the existing arrangements.

According to the invention a method of producing industrially usable gas includes the step of passing hot detarred gas produced in conventional manner through a precipitator adapted to remove at least some of the remaining contaminants therefrom.

Apart from certain solid particles the unwanted contaminants may for example include certain oils. Preferably the precipitator is of the plate type.

Further according to the invention the hot detarred gas is produced from a suitable carbonaceous material utilising a conventional two-stage producer.

A two-stage producer is characterised in that the gas produced is topped from two vertically spaced levels, the lower level (referred to as the first stage) containing the less volatile components and solids and the upper level (the second stage) containing the more volatile components including the tars and phenols.

Further according to the invention the method includes the steps of passing the gas from the first and second stage respectively through a separator primarily intended to remove at least part of the solid contaminants and a separator primarily intended to remove tars from the gas.

Preferably the separators are of the cyclone type.

Preferably also the method according to the invention includes the step of allowing the gas from the two stages to unite prior to entering the precipitator.

Preferably also the gas from the second stage after passing through the separator is allowed to pass through an electrostatic tar precipitator prior to uniting it with the gas from the first stage.

The invention will now be further described by way of example with reference to the accompanying drawing which illustrates diagrammatically a two-stage producer plant for providing hot clean producer gas according to the method of the invention.

Referring to the drawing the plant includes a two stage producer 2 of the rotary grate type with conventional air fan 3 and steam producing system 4. Coal enters producer 2 through feeder 5 and gas from the first stage is withdrawn from the producer via a bottom outlet communicating with conduit 6 and gas from the second stage via an upper outlet and conduit 7. The first stage gas passes via conduit 6 into a dust and other solid particles removing cyclone 8 for onward movement along conduit 9 to a dust precipitator 10. Similarly gas from the second stage passes from conduit 7 along conduit 11 to a tar cyclone 12 responsible for removing most of the tar from the gas. The substantially detarred gas then passes through an electro-static tar precipitator 13 whereafter it is introduced to conduit 9 at point 14 to pass with gas from the first stage into precipitator 10.

The hot clean gas emerging from precipitator 10 may then be utilised for industrial use.

It will be appreciated that the product of the method according to the invention not only qualifies as a 'clean' gas and obviously has a higher calorific value than is the case with cold clean gas but also solves the problem of disposing of the phenols, the latter remaining entrained in the final product.

It will be further appreciated that also intended for inclusion within the scope of this invention is apparatus suitable for carrying out the method according to the invention.

It will be still further appreciated that with a method and apparatus according to the invention many variations in detail are possible without departing from the scope of the appended claims.

I claim:

1. In a method for producing hot clean industrially usable gas from solid carbonaceous material, such as coal, introduced to a two-stage producer, the steps comprising:

passing first-stage gas from the producer to a first separator to remove solid contaminants therefrom;

passing second-stage gas from the producer to a second separator for removal of tars therefrom;

passing the detarred second stage gas to an electrostatic precipitator for further removal of tar;

mixing the second stage gas from said electrostatic precipitator with the first stage gas passing from said first separator; and passing the mixture of said gases through a dust precipitator for substantial removal of the remaining solid contaminants therefrom.

2. The method of claim 1 wherein the electrostatic precipitator is of the plate type.

3. The method of claim 2 wherein the electrostatic precipitator is adapted to remove solid particle contaminants.

* * * * *